US006416195B1

(12) United States Patent
Lin

(10) Patent No.: US 6,416,195 B1
(45) Date of Patent: Jul. 9, 2002

(54) STAGE LAMP

(75) Inventor: Yu-Chuan Lin, San Chung (TW)

(73) Assignee: Superstar Lighting Company Limited (TW)

( * ) Notice: Subject to any disclaimer, the term of this patent is extended or adjusted under 35 U.S.C. 154(b) by 0 days.

(21) Appl. No.: 09/639,846

(22) Filed: Aug. 16, 2000

(51) Int. Cl.[7] ..... F21V 21/30

(52) U.S. Cl. ..... 362/35; 362/275; 362/285; 362/287; 362/428; 362/811

(58) Field of Search ..... 362/811, 426, 362/428, 386, 35, 275, 272, 285, 286, 287

(56) References Cited

U.S. PATENT DOCUMENTS 3,817,595 A * 6/1974 Edelman et al. ..... 156/91
5,084,803 A * 1/1992 Lan ..... 362/35
5,280,458 A * 1/1994 Scott ..... 368/24

* cited by examiner

*Primary Examiner*—Sandra O'Shea
*Assistant Examiner*—Guiyoung Lee
(74) *Attorney, Agent, or Firm*—Troxell Law Office PLLC

(57) ABSTRACT

A stage lamp is composed of a lower casing, driving device, a support frame, eccentric device, a swing ring, and a globe shade. Once the power is on, the light bulb is lighted up and the output shaft of the driving device actuates to rotate the eccentric rod on the eccentric device. Therefore, the globe shade rotates eccentrically and the swing ring moves pivotally in an arc to make the colored light emitted through the globe shade has irregular lighting change for enhancing dynamic visual delight.

5 Claims, 4 Drawing Sheets

STAGE LAMP

BACKGROUND OF THE INVENTION

1. Field of the Invention

The present invention relates to an improvement of stage lamp, and particularly to a stage lamp, which provides a function of twisting movement about an eccentric device.

2. Description of Related Art

The development of stage lamp is getting complicated due to the business of performing arts being getting compact. Generally, the lighting of stage lamp accompanying with changeable sound can enhance the air on the stage such that the performance on the stage can be brought into a climax accordingly. Therefore, for a design, especially for a design of stage, the lighting effect is an extremely important part has to be considered.

As shown in FIG. 1, a known rotary type of stage light usually has a bottom plate A with hollow vertical post B at the center thereof. The vertical post B at the upper end thereof is provided with a lamp socket B1. A transmission device C is disposed laterally and an output shaft thereof provides a gear C1. A stepped part B2 is provided on the post B to correspond to the gear C1. A rotary seat D fits with the post B and is supported by the stepped part B2 such that the gear ring D1 at lower end meshes with gear C1. A lower casing E is associated with the bottom plate A and the post B and the rotary seat D extend outward through a central hole E1 of the casing E. Meanwhile, a light bulb F engages with the lamp socket B1 and an enclosed globe shade G has a connecting part G1 to connect a pivotal part D2 on the rotary seat D. Furthermore, the surface of the globe shade G is attached a plurality of transparent colored pieces G2. When the power is connected, the light bulb F is lighted up and the output shaft of the transmission device C rotates to allow the gear C1 driving the gear ring D1. Thus, the rotary seat D with globe shade G rotates with respect to the post B. The light emitted from the light bulb passes through the colored pieces to form colored lights projecting the stage. The deficiency of the prior art is that the rotary seat D with. the globe shade G generates only a pure rotation and it becomes boring without freshness after a period time of using.

SUMMARY OF THE INVENTION

An object of the present invention is to provide a stage lamp, which has a structure of eccentric movement to offer a rotation in a way of twisting about an eccentric device, for enhancing a dynamic visual delight.

Another object of the present invention is to provide a stage lamp, in which an eccentric moving globe shade accompanying the emitted light make irregular lighting change for enhancing dynamic visual delight.

A further object of the present invention is to provide a stage lamp, in which the parts are assembled fast and easily to lower the production cost substantially.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
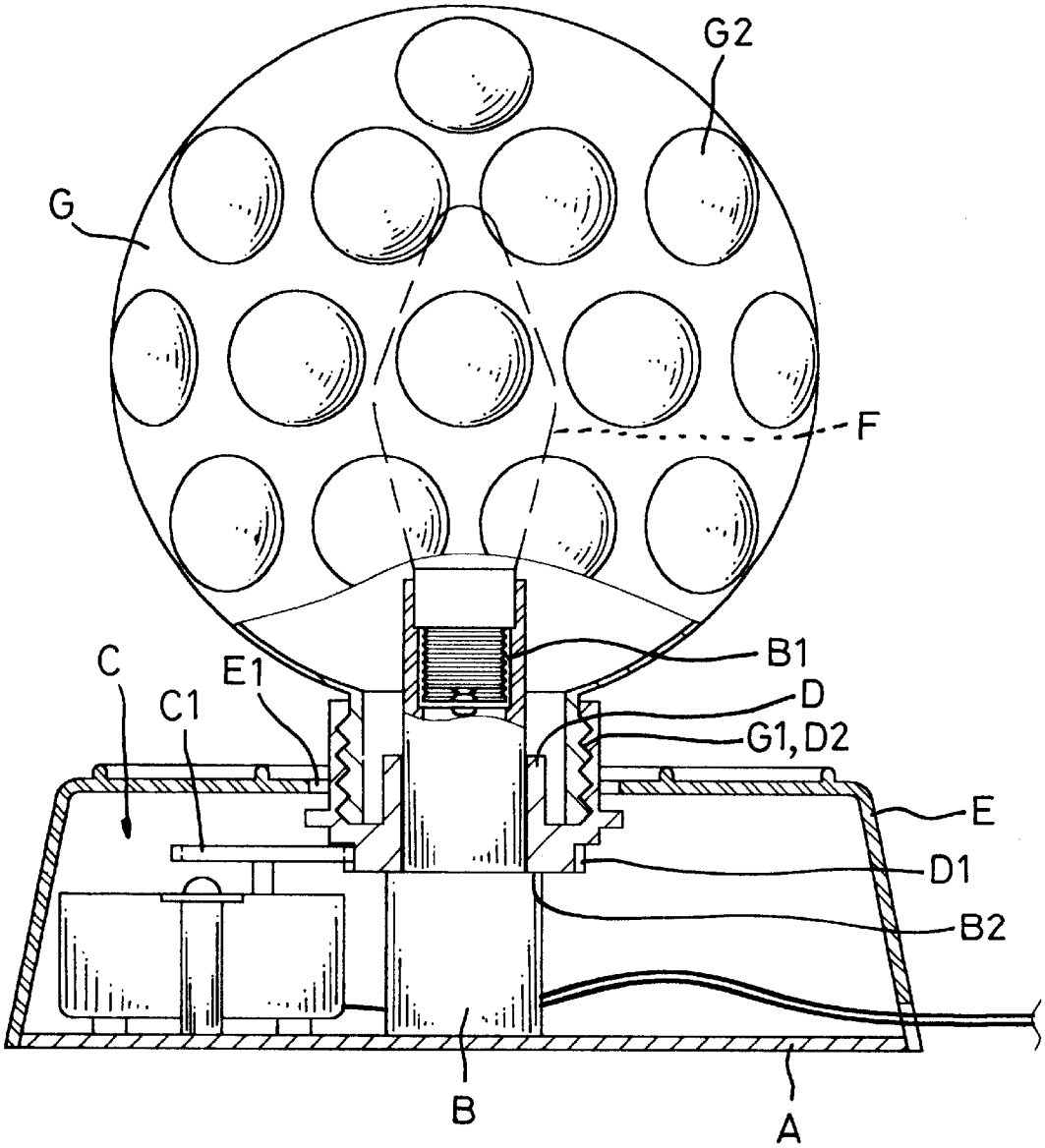
(PRIOR ART) FIG. 1
FIG. 1 is a sectional view of a known stage lamp.
Figure 2:
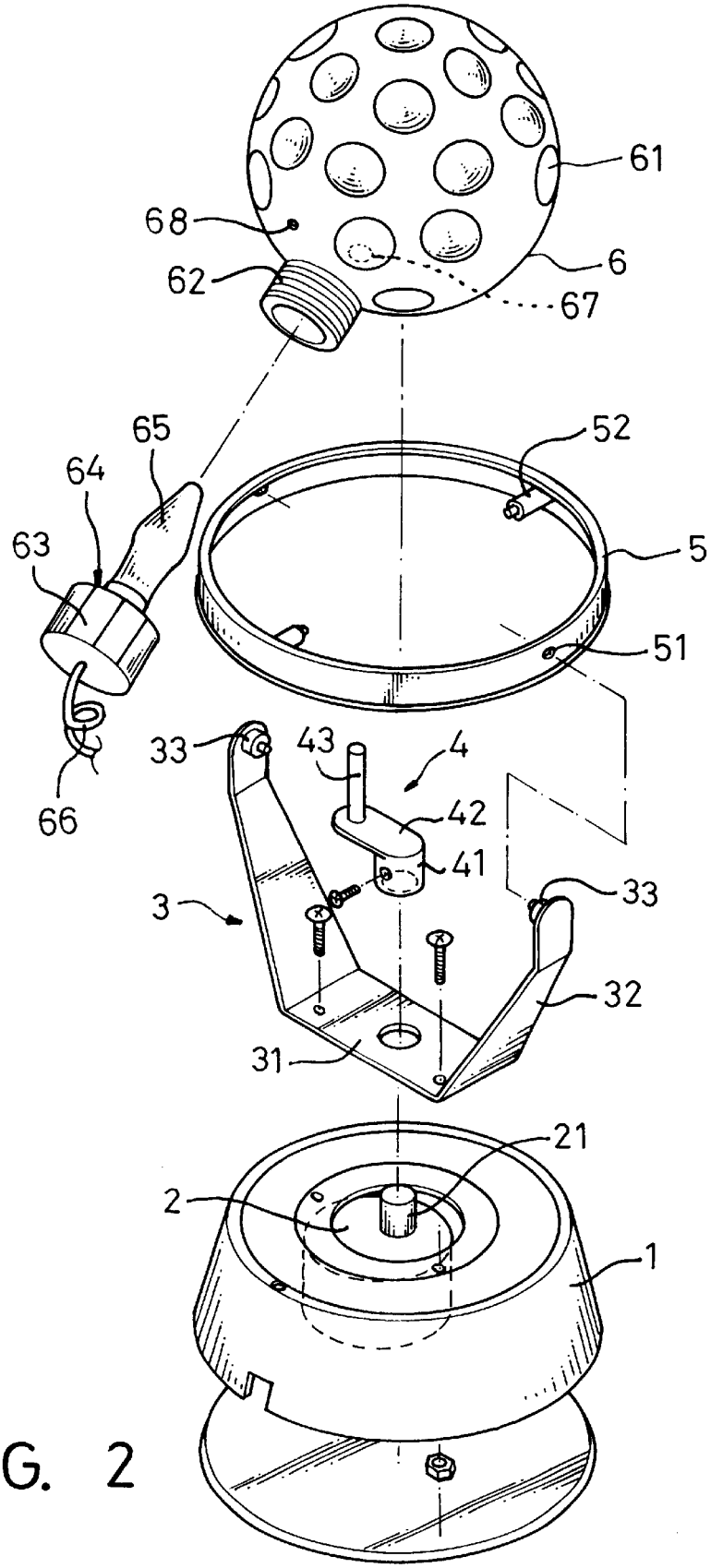
FIG. 2 is an exploded perspective view of stage lamp according to the present invention.
Figure 3:
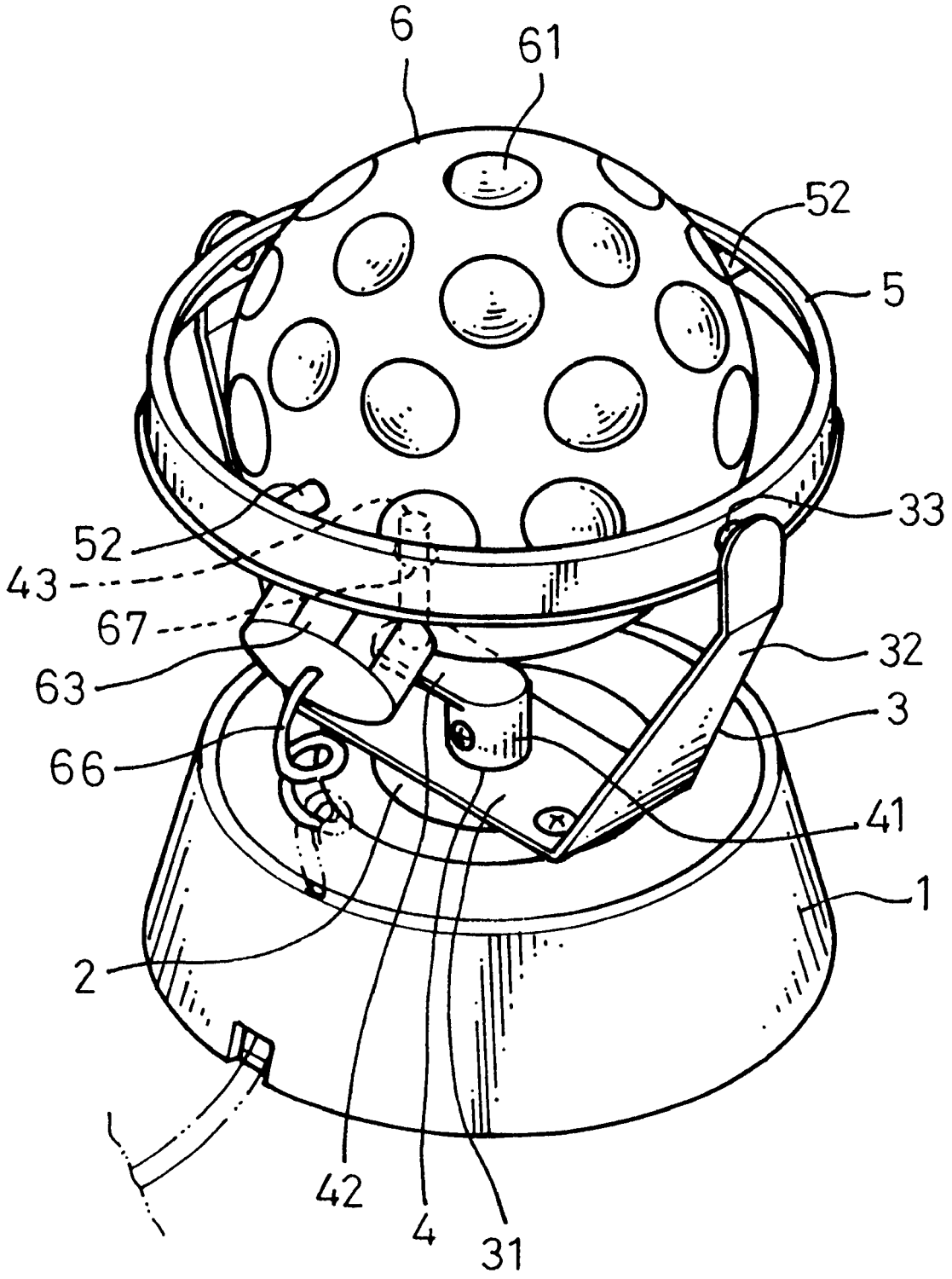
FIG. 3 is an assembled perspective view of the stage lamp shown in FIG. 2.

Referring to FIGS. 2, and 3, basically, a stage lamp of the present invention comprises a lower casing 1, transmission device 2, a support frame 3, eccentric device 4, a swing ring 5 and a globe shade 6.

The lower casing I therein is fixed with a driving device 2 such as motor. An output shaft 21 of the transmission device extends outward from the casing 1.

The support frame 3 further comprises a lower frame plate 31 and both ends of the lower frame plate 31 extend upward a flap plate 32 respectively to correspond to each other. The lower frame plate 31 is disposed on the top of and fixed to the lower casing 1 so as to be passed by the output shaft 21. A distance between the flap plates 32 a little longer than the outer diameter of the swing ring 5 and a pivot 33 is disposed at the free end of the respective flap plate 32 extending inward oppositely to pivotally associate with the swing ring 5.

The eccentric device 4 has a hollow coupling head 41 to engage with the output shaft 21 so as to rotate with the output shaft 21 synchronously. A transverse link 42 at an end thereof is fixedly attached to the coupling head 41 and an eccentric rod 43 extends right upward and is fixedly attached to the other end of the transverse link 42.

The swing ring 5 is a circular ring and provides two opposite engaging holes 51 corresponding to the pivots 33 on the flap plates 32 respectively. Hence, the swing ring 5 can pivotally move on the support frame 3 by way of the pivots 33 engaging with the engaging holes 51. Besides, two ring pivots 52, which are disposed oppositely and extend inward, fixedly attached to the swing ring 5 and are so arranged that an angular angle between the respective ring pivot 52 and the respective engaging hole 51 is 90°.

The globe shade 6 has an outer diameter a little smaller than the inner diameter of the swing ring 5 and a plurality of differently colored pieces 61 are provided on the surface thereof. An engaging part 62 extends outward from the globe shade 6 to engage with an engaging part 64 in a lamp socket 63 and a light bulb 65 is fixed to the lamp socket 63 at the front end thereof so as to be received in the globe shade 6. In addition, the electric sire 66 extended from the lamp socket 63 is preferably coiled and concealed in the lower casing 1. The stage lamp of the present invention features that the global shade 6 has a fitting aperture 67 to be inserted through by the eccentric rod 43 such that the globe shade 6 can be rotated by way of the movement of the eccentric rod 43. Furthermore, the globe shade 6 provides two engaging holes 68 corresponding to the pivots 52 such that the globe shade 6 can be mounted in the swing ring 5 by way of the pivots 52 engaging with the engaging holes 68.

Figure 4:
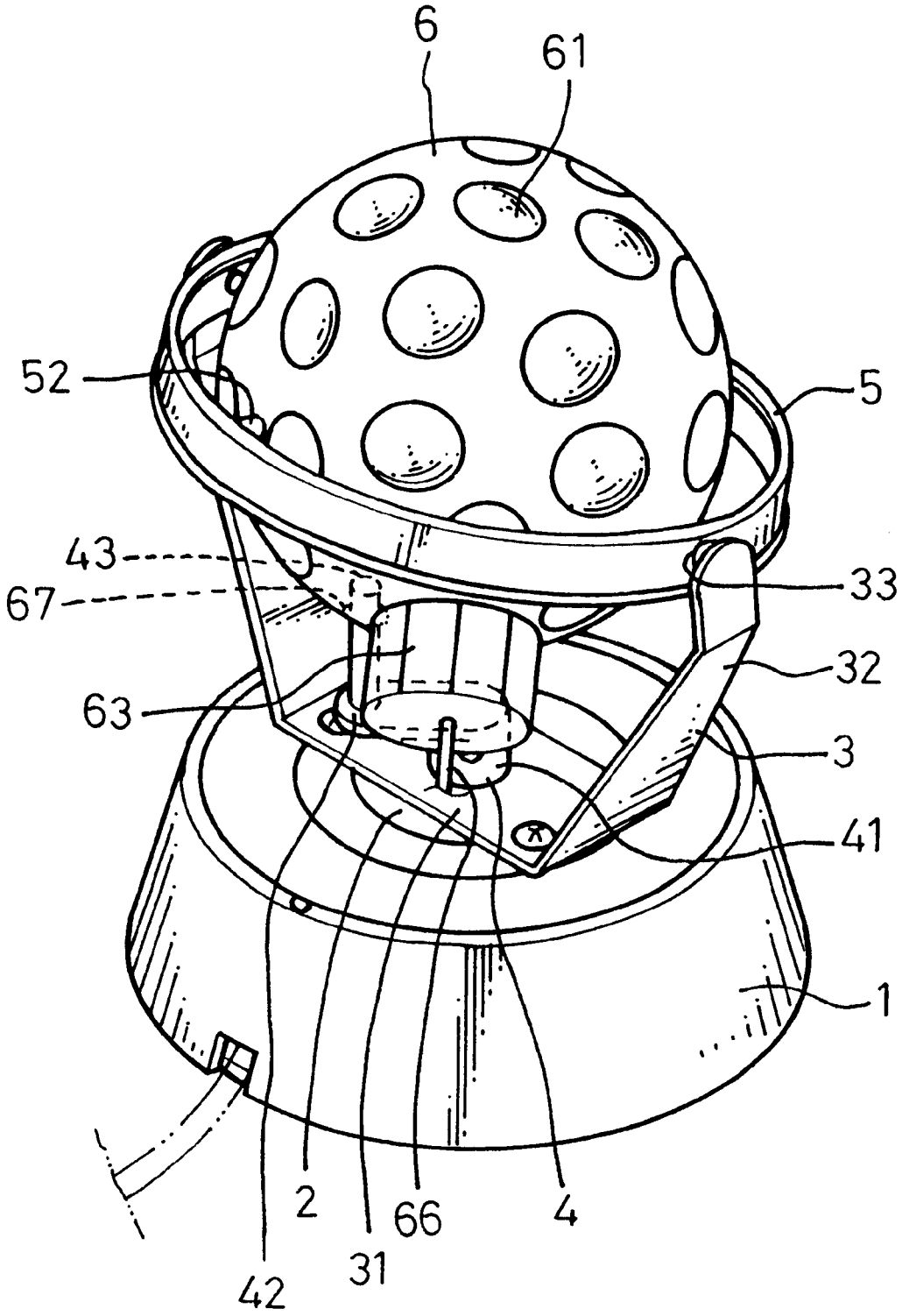
FIG. 4 is a perspective view similar to FIG. 3 illustrating the stage lamp being a state of moving.

Once the stage lamp of the present invention is assembled as described above, the operation for the stage lamp can be performed as illustration of FIGS. 3 and 4. Referring to FIGS. 3 and 4, the light bulb 65 is lighted up as soon as the power is on and the output shaft 21 of the transmission device 2 starts to rotate such that the eccentric device 4 may rotate synchronously to make the globe shade 6 turn eccentrically. Because the globe shade 6 connects with the swing ring 5 at pivots 52 thereof and the swing ring 5 pivotally moves with respect to the pivots 33. Thus, it is possible for the stage lamp to perform a movement of twisting about. In the meantime, the light emitting out by the light bulb 65 may pass through the colored pieces 61 to present an effect of irregular lighting change.

In practice, the present invention makes the stage lamp rotate eccentrically with swing ring moving in an arc and an effect of dynamic visual delight can be enhanced substantially. In addition, the eccentric movement of the globe shade makes the light emitted through the colored pieces and it results in irregular changeable lighting. Moreover, the support frame and the swing ring in the stage lamp of the present invention are made of plastic and by way of injection molding and it makes the assembly work easier and faster such that the production cost can be lowered effectively. Hence, it can make the stage of the present invention suitable for ordinary home audio amusement popularly.

While the invention has been described with reference to a preferred embodiment thereof, it is to be understood that modifications or variations may be easily made without departing from the spirit of this invention, which is defined by the appended claims.

What is claimed is:

1. A stage lamp, comprising;

a lower casing with a top;

a driving device mounted in the lower casing and having an output shaft extending therefrom:

a support frame, having a lower frame plate with two ends and fixedly attached to the top of the lower casing, flap plates extending upwardly from the two ends of the lower frame plate and an inwardly extending pivot attached to each flap plate at a free end thereof;

an eccentric device, having a coupling head coupled to the output shaft, a transverse link extending from the coupling head, and an eccentric rod vertically disposed at a free end of the transverse link eccentric to the output shaft;

a swing ring disposed between the flap plates, having a pair of engaging holes pivotally engaging the pivots on the flap plates respectively, and having two ring pivots extending inwardly from opposite sides of the swing ring;

a global shade having a plurality of colored pieces on a surface thereof, and including a lamp socket extending outwardly therefrom with an electrical wire concealed in the lower casing, with a light bulb received therein and attached to the lamp socket, the globe having a fitting aperture receiving the eccentric rod so as to pivotally support the globe thereon, and two engaging holes engaging the ring pivots so as to be pivotally supported in the swing ring;

whereby, once the power is on, the light bulb is lighted and the output shaft rotates the eccentric rod such that the globe shade rotates eccentrically and the swing ring moves pivotally in an arc to make colored light emitted through the globe shade have irregular lighting changes.

2. The stage lamp as defined in claim 1, wherein the driving device is a motor.

3. The stage lamp as defined in claim 1, wherein axes passing through the engaging holes and through the ring pivots on the swing ring form an angle of 90° with each other.

4. The stage lamp as defined in claim 1, wherein the electrical wire extending from the lamp socket is coiled.

5. The stage lamp as defined in claim 1, wherein support frame and the swing ring are made of injection molded plastic.

* * * * *